US005560311A

United States Patent [19]

Bernson

[11] Patent Number: 5,560,311

[45] Date of Patent: Oct. 1, 1996

[54] ARRANGEMENT FOR A BOOM ON A SAILING BOAT

[75] Inventor: Christer Bernson, Västra Frölunda, Sweden

[73] Assignee: Selden Mast AB, Vastra Frolunda, Sweden

[21] Appl. No.: 448,121

[22] Filed: May 23, 1995

[30] Foreign Application Priority Data

Jun. 2, 1994 [SE] Sweden ..... 9401898

[51] Int. Cl.[6] ..... B63H 9/10

[52] U.S. Cl. ..... 114/97; 114/104

[58] Field of Search ..... 114/97, 104–106, 114/102, 89, 109; 254/229; 440/59

[56] References Cited

U.S. PATENT DOCUMENTS 3,280,780 10/1966 Aulin ..... 114/106
4,059,063 11/1977 Hood et al. ..... 114/102
4,061,101 12/1977 Cook ..... 114/106
4,499,841 12/1985 Lord ..... 114/97
4,708,670 11/1987 Peters ..... 440/59

*Primary Examiner*—Sherman Basinger
*Attorney, Agent, or Firm*—Dvorak and Traub

[57] ABSTRACT

The invention relates to an arrangement for a boom on a sailing boat which carries a sail capable of being wound onto a mast. Actuation of the sail is with a force F from a drive motor. In conjunction with this a rotatably driven screw accommodated within the boom is capable of attachment on one side of the aforementioned drive motor and is connected on the other side to the sail via a movement transmission.

5 Claims, 5 Drawing Sheets

ARRANGEMENT FOR A BOOM ON A SAILING BOAT

The present invention relates to an arrangement for a boom a sailing boat, Which carries a sail capable on of being wound onto a mast, for the actuation of said sail with a force from a drive motor.

Auxiliary means are provided for use in conjunction with operation of the mainsail for hauling out and hauling in same, as well as for extending or retracting the sail while sailing the boat. Amongst other things, there is also said to be an hydraulically operated motor housed internally within a boom.

The principal object of the present invention is, therefore, in the first instance to make available an arrangement for a boom intended to permit, amongst other things, the aforementioned operation of the sail to be achieved with great effect and precision and by simple and efficiently functioning means.

Said object is achieved by means of an arrangement in accordance with the present invention, which is characterized essentially in that a rotatably driven screw accommodated within the boom is capable of attachment on one side by means of a drive motor of the aforementioned kind, and is connected on the other side to the sail via movement transmission means.

The present invention is described below as a preferred illustrative embodiment, in conjunction with which reference is made to the accompanying drawings, in which FIG. 1 shows a side view of a boom with an arrangement for actuating the sail illustrated schematically as a partially sectioned view;

Figures 1, 1A:
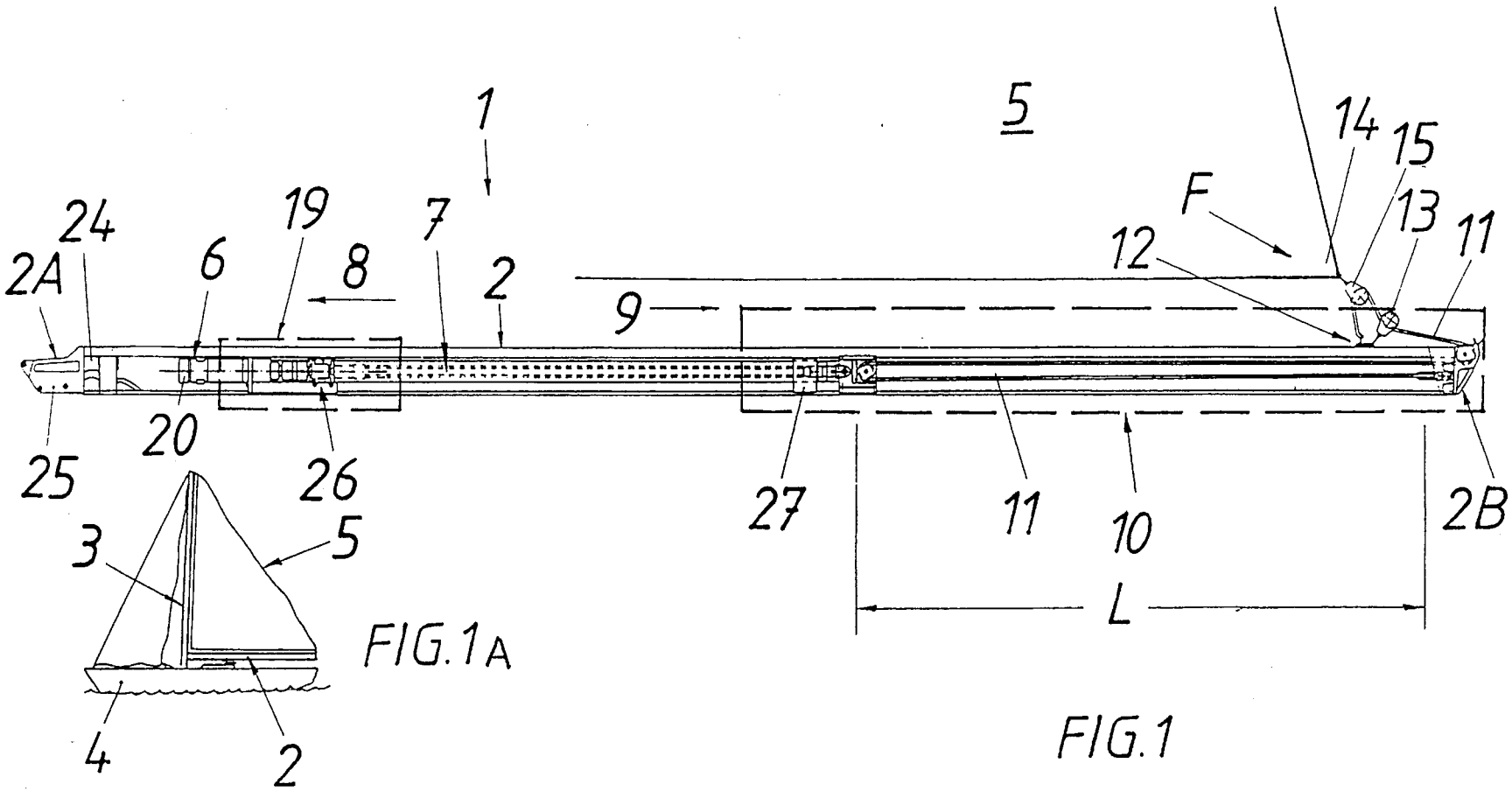
Figure 2:
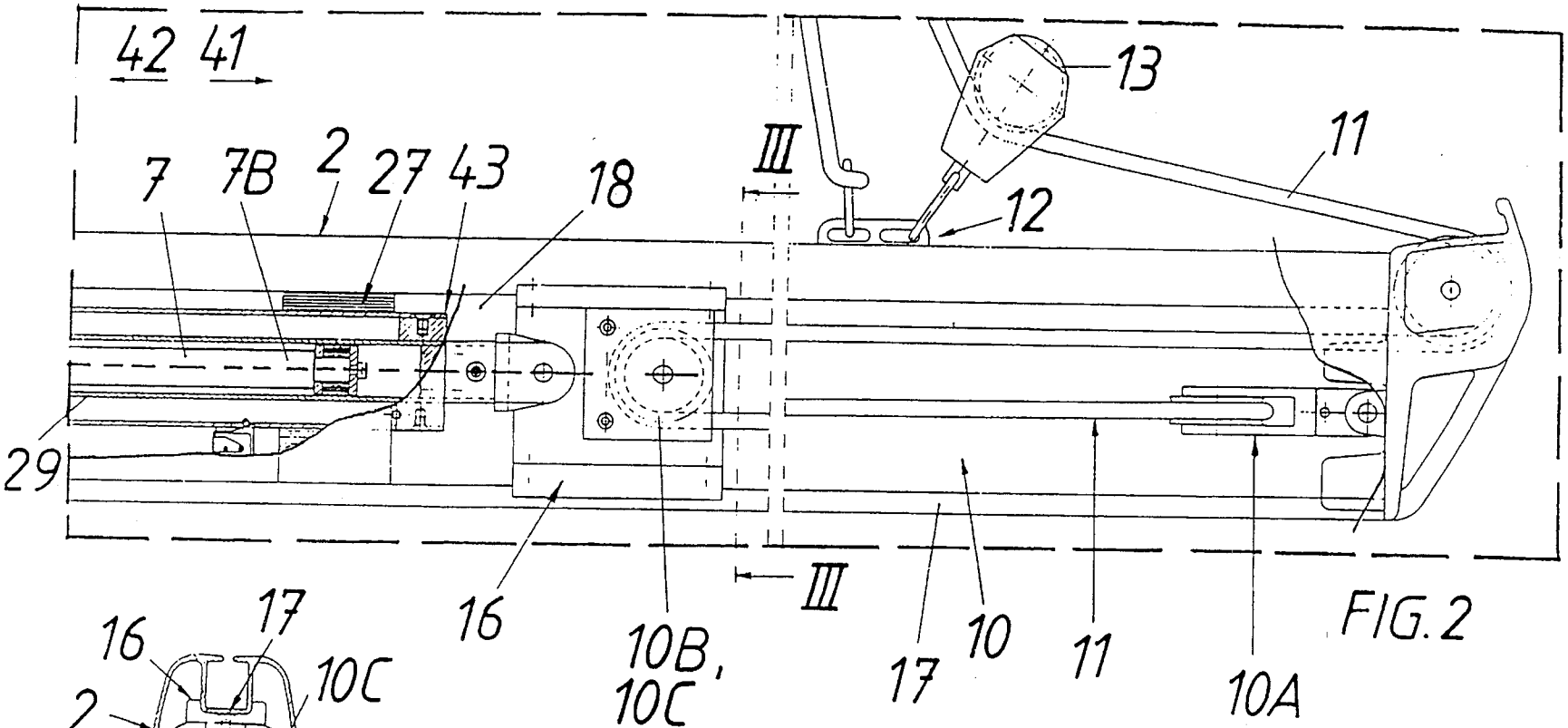
FIG. 2 shows the rear part of the boom and the arrangement in a partially sectioned state.
Figure 3:
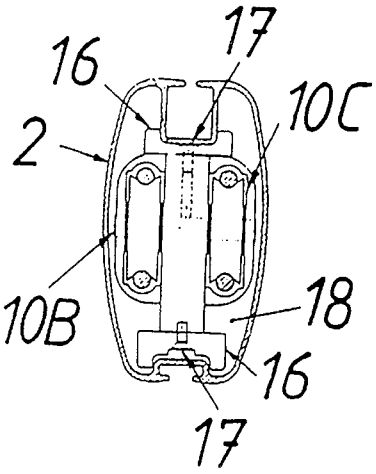
FIG. 3 shows a section along the line III—III in FIG. 2.
Figure 4:
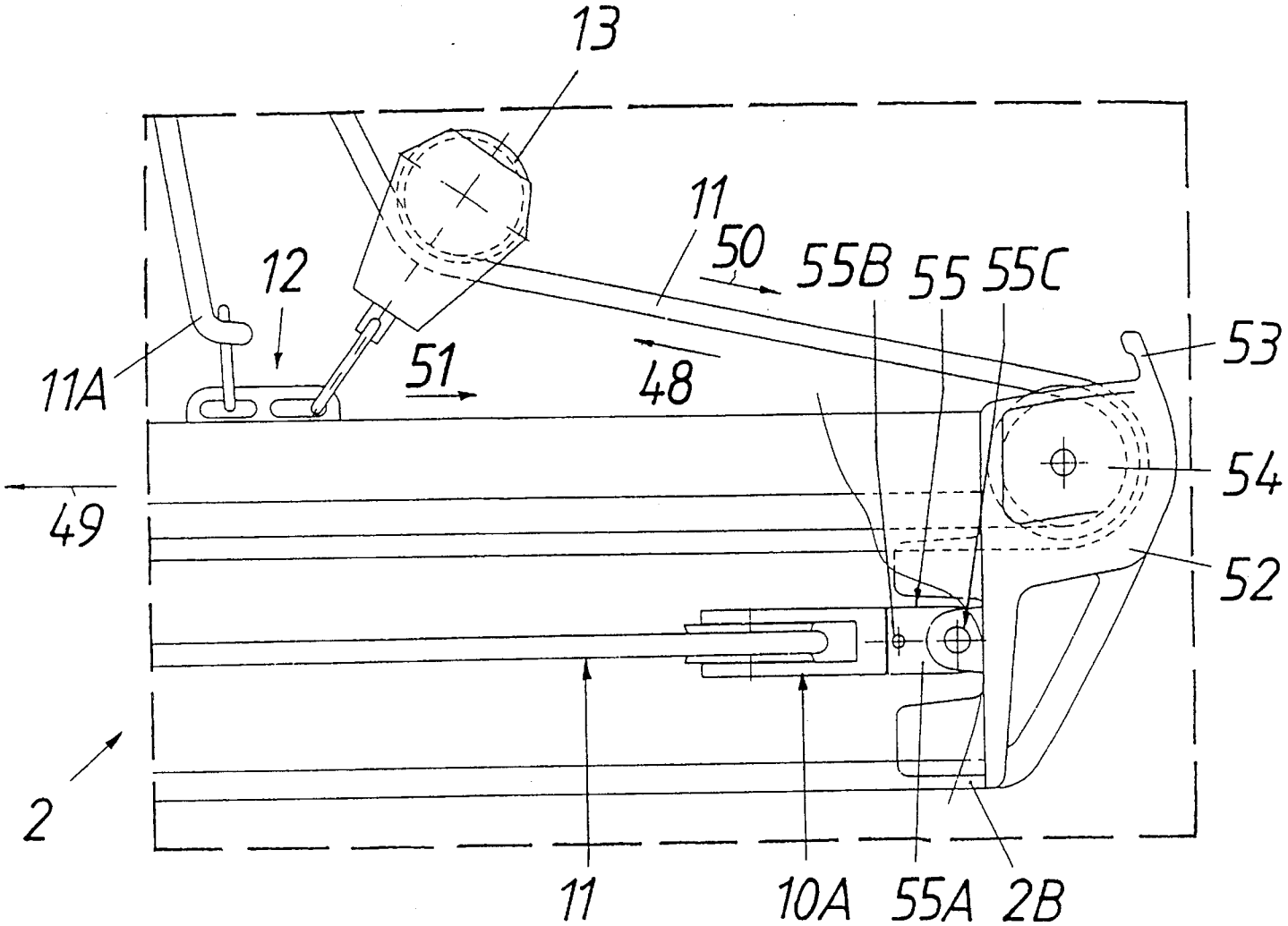
FIG. 4 shows the extreme rearmost part of the boom.
Figure 5:
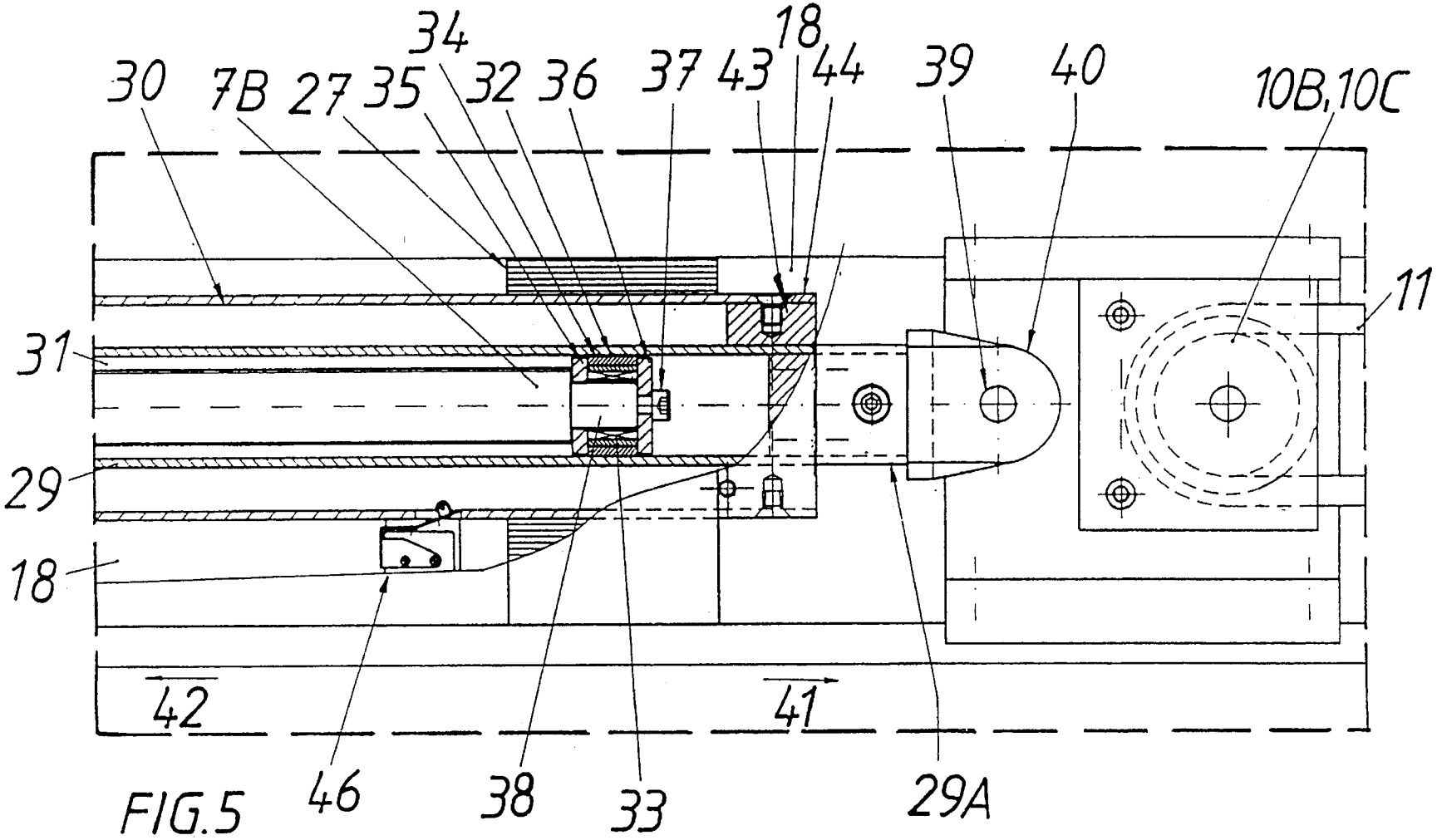
FIG. 5 shows the central part of the arrangement in the boom.
Figure 6:
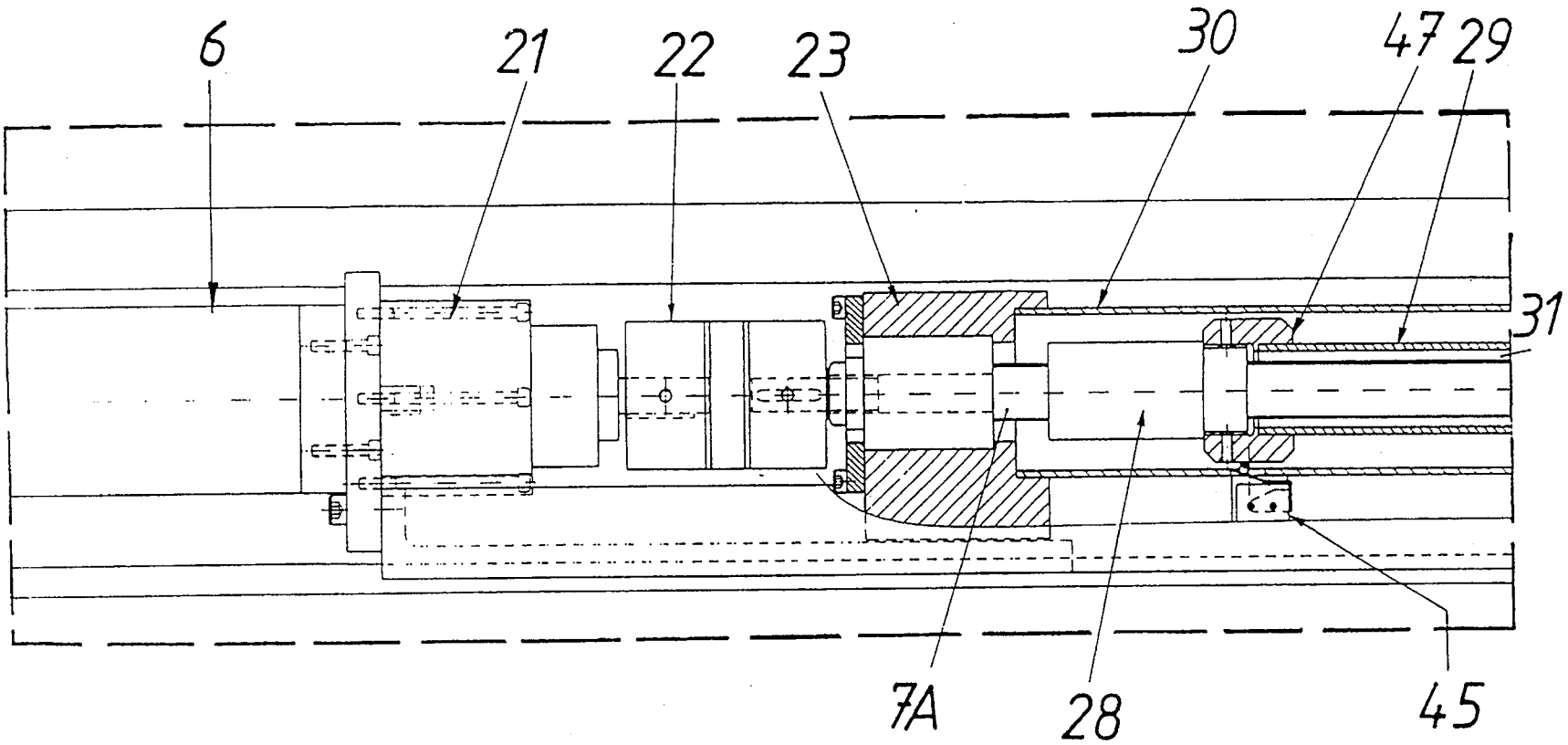
FIG. 6 shows the front part of the arrangement.

An arrangement 1 for a boom 2, which is supported at its front end 2A pivotally mounted about a mast 3 of a sailing boat 4, which has a sail 5 capable of being wound onto the mast 3, for the actuation of said sail 5 with a force F obtained from a drive motor 6, has the motor 6 and the arrangement 1 accommodated internally within said boom 2. Included in the arrangement 1 is a rotatable screw 7 accommodated within the boom 2. Said screw 7, viewed in the direction of its one side 8, is capable of attachment to the drive motor 6. On the other side 9, the screw 7 is connected to the sail 5 via appropriate movement transmission means 10.

Said movement transmission means preferably consist of a number of line blocks 10A; 10B, 10C, respectively single and double blocks, with a line 11 departing from said blocks 10A–10C and capable of connection to said sail 5 deflected around a deflector pulley 13 attached to a boom sail runner 12 or some other line securing component, and a hauling-out block 15 attached to the clew 14 of the sail. One of said blocks, preferably the double block 10B, 10C, is appropriately arranged in a block bearing component in the form of a runner 16 accommodated within the boom 2 and capable of displacement along a groove 17 preferably consisting of the inward-facing bottom profile of the boom in the internal accommodating cavity 18 of the boom.

In order, amongst other things, to permit simple application and assembly of the drive motor 6 and the parts belonging thereto contained in a motor assembly 19, such as a brake 20, a gear 21, a clutch 22 and a screw end bearing 23, for the screw and the associated movement transmission means, these can be so arranged as to be introduced simply as a pre-assembled unit through the inward-facing boom end opening 24 of the boom, prior to screwing an inner boom end guard 25 securely to the hollow profile part of the boom. Said motor assembly 19 is connected to the boom 2 only via an attachment 26, preferably by means of screws, whereas the remaining part of the drive screw 7 is supported in a stress-free state by an inner bearing 27. Simple manufacture is permitted in this way, as well as assembly without stresses from a number of securing points being generated in the boom 2, in addition to which great accuracy is not now required.

Also, the end 7A of the screw facing towards the motor 6 is securely attached to a rotating component 28 in the form of a rotating nut, which in turn is attached to a piston 29. Said piston 29, which is accommodated in such a way that it is capable of displacement internally within a sleeve 30 in the boom 2, is in the form of a tube, in the inner cavity 31 of which the free end 7B of the screw is mounted in a rotatable fashion supported by a bearing 32. The bearing 32 can consist of a rotating bearing 33, a casing 34 and a couple of bearing casing washers 35, 36 at a certain distance apart, which washers are retained by a screw 37 on a screw end shaft 38.

Said sleeve 30 is mounted supported in the boom 2 by means of a bearing 27 consisting of foam material.

Said piston 29 is attached to the aforementioned moving bearing component 16 in the block construction 10 for the hauling line 11 via a shaft 39 and a securing component 40. The piston 29 is accommodated supported at its free end 29A in such a way as to be capable of displacement in the longitudinal sense 41, 42 of a bearing 43 carried at the free end 44 of the sleeve 30, which comprises a bush 43 screwed securely in place.

The end positions for said displacement of the sliding piston 29 are determined by limit switches 45, 46 in the form of microswitches, which are activated by a thickened stop component 47 on the nut 28, in conjunction with which the drive motor 6, preferably executed as an electric motor, is controlled in such a way as to be started and stopped, or to be driven in the opposite direction in order to cause the piston 29 to be displaced in the desired direction 41, 42 for the purpose of hauling out or hauling in the sail 5 and respectively of regulating the extension or retraction of the sail while sailing.

The function of the arrangement is such that, when the motor 6 is caused to rotate the screw 7 in one of its directions of rotation, the nut 28 moves along the screw 7 in the direction of displacement 41 and in so doing causes the piston 29 that is attached to the nut in a non-rotating fashion to cause the block bearing 16 to be displaced, in so doing reducing the distance L between the line blocks 10A and 10B, 10C that are arranged laterally 8, 9 at a certain distance from one another, thereby permitting retraction of the line 11 so that it is permitted to be pulled out in the running direction 41 and allowing the boom sail runner 12 to accompany it as the sail is furled, for example around a vertical pulley shaft of a previously disclosed kind arranged on the mast, for which reason it is not described in any greater detail or illustrated in the drawings, in the direction 49 of hauling in.

The limit micro-switch 46 interrupts the operation of the motor once the nut 28, 47 has travelled for a sufficient distance backwards along the boom 2 for the sail 5 to be considered to have been furled to its full extent around the mast shaft.

Actuation of the motor 6, for example from the cockpit of the boat or some other operating position on board via a button or lever, etc., causes the screw 7 to be rotated in the opposite direction of rotation to that described above. This causes the nut 28, 47 to move in the running direction 42 along the screw, so that the distance L between the line blocks 10A and 10B, 10C is increased, contrary to what is stated above, with the result that the effective length of the line internally within the boom 2 is increased, in conjunction with which it is accordingly reduced outside the boom and is caused to run in the direction of feed 50, with the result that the boom sail runner 12 is caused to be pulled out in the direction 51 of hauling out, thereby hauling out the sail 5 first from its fully hauled-in stowage position and then progressively as it is wished to extend the sail while sailing the boat.

An outer boom end guard 52 secured to the boom 2 at its rear outer end 2B has a stop 53 in addition to a line block 54 for deflecting the line 11 at the rear outer end 2B of the boom, which prevents the sail 5 from being pulled out too far.

The line 11 can be secured by its end opposite the end 11A facing away from the runner 12 to said boom end guard 52, to which the rear line block 10A is also secured via a pivot bearing 55 comprising a bracket 55A and pins 55B, 55C. By causing the line end to be accessible for actuation from outside the boom 2, the entire system with the line 11 and the blocks 10A–10C can be regulated so as to adjust and set the distance between the blocks 10A and 10B, 10C.

An efficiently functioning and simply executed sail hauling arrangement 1 enclosed within the boom 2 of a boat of the kind described is thus achieved in accordance with the invention. A high degree of serviceability is provided for in this way, in that various components in the form of compact units can be fitted to and accordingly also removed from a boom 2 of the kind described here without problems, after first having removed the inner boom end guard 25 situated at the front of the boom, to which the boom is secured pivotally supported by a mast.

The invention is not, however, restricted to the illustrative embodiment of the arrangement described above and illustrated in the drawings, but may be varied within the scope of the Patent Claims without departing from the idea of invention.

I claim:

1. An arrangement for a boom on a sailing boat which carries a sail that is capable of being wound onto a mast by a motor, comprising:

a hollow boom having an internal cavity, an inner end pivotably mounted to said mast, and an outer end connected to said sail by a line block, said motor received within said cavity at said inner end and connected to said boom by an attachment, said motor having a brake and a gear, said gear attached to a clutch, wherein said clutch is attached to an end bearing, said clutch, gear, end bearing, and motor comprising a motor assembly;

a transmission means received within said internal cavity at said outer end of said boom and having a pair of ends, said means having one end connected to said line block and another end connected to a displaceable piston, said piston in the form of a hollow tube, said piston connected to said motor assembly through a rotating component in the form of a nut;

a sleeve received within said boom and having a fixed end and a free end, said fixed end attached to said end bearing of said motor assembly, and said free end being supported in a stress-free state by a bearing, said sleeve terminating at said free end in close proximity to said transmission means, said sleeve receiving said displaceable piston therein; and a rotatably driven screw received within said hollow piston tube, said screw having a fixed end and a free end, said fixed end attached to said rotating nut component and said free end mounted in a rotatable ,fashion within said piston by a rotating bearing.

2. The arrangement of claim 1 wherein the sleeve is mounted and supported within the boom by means of a bearing, said bearing consisting of a foam material.

3. The arrangement of claim 2 wherein the piston is attached to a moving block bearing component, said bearing component comprising a block, construction for a line.

4. The arrangement of claim 3 wherein the block bearing component is in the form of a runner accommodated within the boom and capable of displacement along a groove formed therein.

5. The arrangement of claim 4, wherein said transmission means is comprised of a number of line blocks and said block bearing component, and wherein a line departing from said blocks is capable of connection to said sail and to a line securing component mounted in such a way as to be capable of displacement along the boom.

* * * * *